US010077625B2

(12) United States Patent
Maenza et al.

(10) Patent No.: US 10,077,625 B2
(45) Date of Patent: Sep. 18, 2018

(54) SUBTERRANEAN PACKER SEALING SYSTEM LOAD DIVERTER

(71) Applicant: BAKER HUGHES INCORPORATED, Houston, TX (US)

(72) Inventors: Frank J. Maenza, Houston, TX (US); Nicholas S. Conner, Cypress, TX (US); Gary L. Anderson, Humble, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 262 days.

(21) Appl. No.: 15/055,854

(22) Filed: Feb. 29, 2016

(65) Prior Publication Data

US 2017/0247974 A1 Aug. 31, 2017

(51) Int. Cl.

| | |
|---|---|
| ***E21B 33/1295*** | (2006.01) |
| ***E21B 33/129*** | (2006.01) |
| ***E21B 33/128*** | (2006.01) |

(52) U.S. Cl.

CPC ..... *E21B 33/1293* (2013.01); *E21B 33/128* (2013.01); *E21B 33/1285* (2013.01); *E21B 33/1295* (2013.01)

(58) Field of Classification Search

CPC ..... E21B 33/129; E21B 33/1293; E21B 33/1291; E21B 33/1292; E21B 23/06

See application file for complete search history.

(56) References Cited

U.S. PATENT DOCUMENTS

| | | | | | |
|---|---|---|---|---|---|
| 1,810,352 | A * | 6/1931 | Humason | E21B 23/06 | 166/134 |
| 3,374,837 | A * | 3/1968 | Page | E21B 33/1295 | 166/120 |
| 4,515,213 | A * | 5/1985 | Rogen | E21B 33/1212 | 166/123 |
| 5,046,557 | A * | 9/1991 | Manderscheid | E21B 33/1295 | 166/120 |
| 5,113,939 | A | 5/1992 | Ross, Jr. et al. | | |
| 5,273,109 | A * | 12/1993 | Arizmendi | E21B 133/1292 | 166/123 |
| 5,366,010 | A * | 11/1994 | Zwart | E21B 17/02 | 166/120 |
| 5,904,207 | A * | 5/1999 | Rubbo | E21B 33/1212 | 166/123 |
| 8,002,045 | B2 * | 8/2011 | Ezell | E21B 23/00 | 166/212 |

* cited by examiner

*Primary Examiner* — Kenneth L Thompson
(74) *Attorney, Agent, or Firm* — Steve Rosenblatt

(57) ABSTRACT

A mandrel and a packer outer assembly are formed to create spring compartments on opposed sides of a sealing element. The outer assembly is shear pinned to the mandrel to minimize spring travel during setting. Once set in the normal way the presence of the springs transfers load and sustained loads through the connected tubular string in either direction. A load coming from downhole and acting in an uphole direction first compresses the spring located uphole from the sealing assembly so that the loading goes behind the sealing assembly and into the upper spring and ultimately to the upper slips. The reverse happens when the force is coming from uphole of the sealing assembly and acting in a downhole direction. The springs can be a coil, a stack of Belleville washers, fluid pushed through an orifice, a resilient material or a contained compressible fluid, to name some examples.

14 Claims, 1 Drawing Sheet

SUBTERRANEAN PACKER SEALING SYSTEM LOAD DIVERTER

FIELD OF THE INVENTION

The field of the invention is compression set packers having slips and a sealing element and more particularly where forces transmitted through the connected tubulars to the mandrel bypass the sealing element to the anchored slip on the opposite side of the sealing element from the direction of the applied force.

BACKGROUND OF THE INVENTION

Compression set packers are set a variety of ways. One way is with a hydraulic or mechanical system that creates relative movement between a mandrel and an outer assembly that drives the slips up respective cones to get a supporting bite into the surrounding tubular as well as extending a sealing assembly radially by compressing axially. Typically, the one slip is extended first and then the sealing assembly is extended followed by another slip assembly. The relative movement to set the packer is generally locked in such as with a ratcheting lock ring that prevents the relative movement from reversing to hold the set position of the components. For release the locking mechanism is defeated either with a tool run into the mandrel to shear a retainer on the locking mechanism or by cutting the mandrel with a tubular cutter to let the components relax and by doing so retract from the surrounding tubular. An upward force on the mandrel then brings the released packer out of the hole.

The act of setting the sealing assembly increases the internal pressure in the resilient components of the sealing assembly. This pressure is needed to maintain the seal against the surrounding tubular. However, while in service loads can be transmitted through the connected tubular string in either of two opposed directions. Such loading transfers into the set sealing assembly raising its internal pressure and decreasing the capacity of the sealing assembly to resist differential pressure in the two zones isolated by the sealing assembly.

The present invention addresses such loads transmitted through the tubular string in either direction and configures the mandrel and outer assembly in such a way that the load transmitted through the tubular is directed around the set sealing element to a slip assembly on the far side of the sealing element without further increasing the internal pressure in the sealing assembly. A pair of springs allow for load transfer behind the sealing assembly to a slip assembly on the far side from the direction of applied tubing load. So that an uphole force through the tubular would compress a spring located uphole of the sealing assembly and transfer such a force to the upper slips on the far side of the sealing assembly. Those skilled in the art will better appreciate these and other aspects of the present invention by a review of the detailed description of the preferred embodiment and the associated drawings while recognizing that full scope of the invention is to be found in the appended claims.

U.S. Pat. No. 5,113,939 shows the use of a ratchet to decouple hanging weight from the sealing element and transfer such weight to a slip assembly below the sealing assembly.

SUMMARY OF THE INVENTION

A mandrel and a packer outer assembly are formed to create spring compartments on opposed sides of a sealing element. The outer assembly is shear pinned to the mandrel to minimize spring travel during setting. Once set in the normal way the presence of the springs transfers load and sustained loads through the connected tubular string in either direction. A load coming from downhole and acting in an uphole direction first compresses the spring located uphole from the sealing assembly so that the loading goes behind the sealing assembly and into the upper spring and ultimately to the upper slips. The reverse happens when the force is coming from uphole of the sealing assembly and acting in a downhole direction. The springs can be a coil, a stack of Belleville washers, fluid pushed through an orifice, a resilient material or a contained compressible fluid, to name some examples.

DETAILED DESCRIPTION OF THE PREFERRED EMBODIMENT

Figure 1:
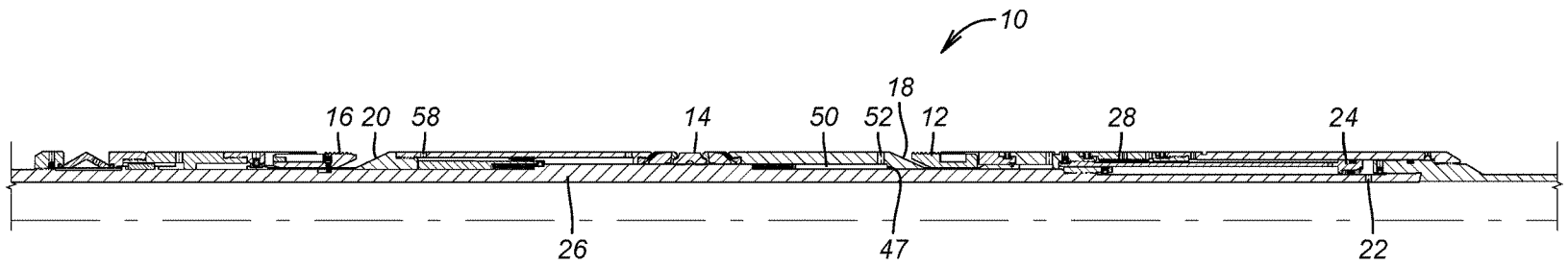
FIG. 1 is a section view of the packer in the run in position

The packer 10 has lower slips 12, a sealing element 14 and upper slips 16. Lower slips 12 ride out to a surrounding tubular that is not shown on cone 18 while upper slips 16 ride out on upper cone 20. Pressure in port 22 pushes piston 24 while mandrel 26 is held fixed so that the setting sequence is that the debris barrier 27 is folded and extends first and then the upper slips 16 bite next, then the sealing element 14 is axially compressed and radially extended and then the lower slips 12 are extended. The set position is retained by the lock ring 28. Thus far what has been described is the way a Premier Packer sold by Baker Hughes Incorporated of Houston, Tex. USA operates.

The present invention involves some modifications that will be described below. The sealing element 14 is straddled by upper spring assembly 30 and lower spring assembly 32. Spring assembly 30 is located between opposed shoulders 34 on mandrel 26 and 36 on cover sleeve 38. Outer sleeve 44 has a ratchet profile 40 that moves relative to the ratchet profile 42 on cover sleeve 38 that is initially pinned to the mandrel 26 with shear pin 46. During setting, outer sleeve 44 moves uphole relative to the stationary cover sleeve 38 due to ratchet pattern 40 moving uphole relative to stationary ratchet pattern 42. Spring assembly 32 is located between shoulder 48 on mandrel 26 and shoulder 47 on cone 18. Note the large gap 50 in the FIG. 1 position between shoulder 47 and lower spring assembly 32. Setting the packer 10 does not meaningfully compress spring assembly 32 but simply results in closing gap 50. Port 52 prevents liquid lock as the gap 50 changes size.

Figure 2:
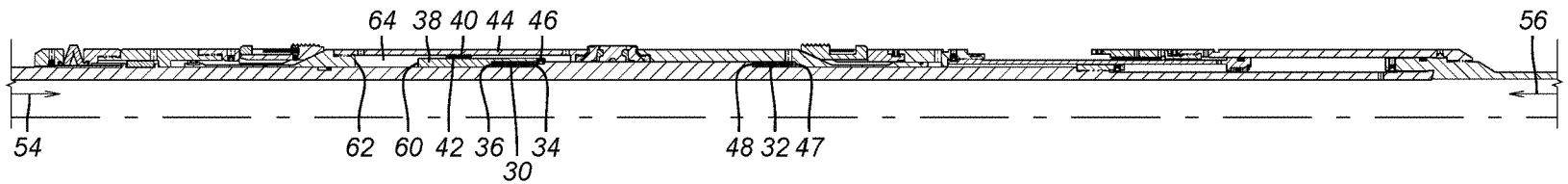
FIG. 2 is the view of FIG. 1 in the set position.

Starting from the set position of FIG. 2 loads to the mandrel 26 can occur in a downhole direction as indicated by arrow 54 or in an uphole direction as indicated by arrow 56. Net downhole oriented forces indicated by arrow 54 can come from setting down weight at the surface, allowing string weight below the packer 10 to hang or a higher pressure uphole of set sealing element 14 than the pressure downhole of set sealing element 14. Force in the uphole direction represented by arrow 56 can occur with higher pressure downhole of the sealing element 14 than uphole or pulling tension on a tubular string from above packer 10.

The spring assemblies 30 and 32 come into play to channel some of the load applied after the packer 10 is set around the set sealing element 14 as opposed to fully through the sealing element 14 as would occur without the spring assemblies 30 and 32. When the loading is in the direction of arrow 56 or in the uphole direction mandrel 26 moves uphole bringing shoulder 34 closer to shoulder 36. The relative movement of the mandrel 26 relative to sleeve 38 breaks shear pin 46. Sleeve 38 cannot move uphole as ratchet pattern 42 cannot move uphole relative to the meshed ratchet pattern 40. As a result the spring assembly 30 is compressed until it reaches a fully compressed position where it simply transfers force through itself into ratchet pattern 40 and then into cone 20 and then into upper slips 16. Thus, when there is a net uphole force on mandrel 26 the force in part bypasses the sealing element 14 and is transferred to the upper slips 16 on the far side of the sealing element 14 from the origin of the net force, in this case in the direction of arrow 56. Shoulder 48 moves away from shoulder 47 to allow the spring assembly 32 to relax.

Conversely, if the net downhole force in the direction of arrow 54 materializes shoulder 48 on mandrel 26 tries to move closer to shoulder 47 on cone 18. As a result the spring assembly 32 is compressed until it is capable of just conducting force through itself and into cone 18 and then into the lower slips 12.

Port 58 serves a similar function as port 52. Spring assemblies 30 and 32 can be coiled springs, Belleville washer stacks, a compressible resilient material such as an elastomer, a sealed chamber with a compressible fluid or two sealed chambers separated by an orifice and filled with a compressible fluid that is forced through the orifice or other equivalents to a biasing device that permits relative movement while offering some resistance to such movement and at some point just acting as a conduit for applied force. The ratchet interfaces 40 and 42 can be replaced with comparable structures that span the gap 64 that opens between surface 60 on sleeve 38 and surface 62 on upper cone 20. Such locking structures are not needed below the seal assembly 14 to transfer force in the direction of arrow 54 as surface 48 simply approaches stationary surface 47 which is supported by set slip 12.

Those skilled in the art will now readily appreciate that forces that previously were communicated through a set sealing element in either of two opposed directions in past designs now have a way of conducting at least some of that force in an alternative path that is generally parallel path that additionally loads the sealing element when force in the direction of arrows 54 or 56 are applied to the mandrel 26 either from pressure differentials after setting or from mechanical loads such as string weight or tensile or compressive force applied to the attached tubular string to the packer.

As before, the packer 10 of the present invention can be released and retrieved by cutting the mandrel 26 or by defeating the locking mechanism 28 with a tool run into mandrel 26. The spring assemblies 30 and 32 have the ability to soften shock loads until full compression is reached at which point the assemblies act as force conduits to the slip on the far side of the sealing assembly to the direction of the applied force.

The above description is illustrative of the preferred embodiment and many modifications may be made by those skilled in the art without departing from the invention whose scope is to be determined from the literal and equivalent scope of the claims below:

We claim:

1. A packer for subterranean use against a borehole wall, comprising:

a mandrel supporting an outer assembly further comprising a sealing element flanked on opposing sides with an uphole and a downhole slip assembly;

said mandrel, after said sealing element and slip assemblies are engaged to the borehole wall, moving axially relative to said outer assembly for transmitting at least a portion of applied forces to said mandrel in either an uphole or downhole direction, in an alternate path that avoids incremental loading of said sealing element by directing, after said relative movement, a mandrel load in an uphole direction from below said sealing element to a location on said outer assembly above said sealing element through said mandrel or by directing a load on said mandrel in a downhole direction from above said sealing element to a location on said outer assembly below said sealing element through said mandrel and in either case directing incremental loading on said mandrel around said sealing element.

2. The packer of claim 1, wherein:

said alternate path runs through said mandrel.

3. The packer of claim 1, wherein:

a force in an uphole direction on said mandrel passes at least in part under said sealing element to said uphole slip assembly.

4. The packer of claim 1, wherein:

a force in a downhole direction on said mandrel passes at least in part under said sealing element to said downhole slip assembly.

5. The packer of claim 1, wherein:

said mandrel defines an uphole and a downhole space on opposed sides of said sealing element whose volume varies with relative movement between said mandrel and said outer assembly when said outer assembly engages the borehole wall.

6. The packer of claim 5, wherein:

said spaces each contain a biasing member.

7. The packer of claim 6, wherein:

said biasing member conducts force through said alternate path.

8. The packer of claim 6, wherein:

said biasing member comprises at least one of a Belleville washer stack, a coiled spring, a compressible resilient member, a compressible gas sealed in said spaces and an incompressible fluid forced through an orifice and sealed in said spaces.

9. The packer of claim 6, wherein:

said biasing member in said downhole space is compressed when transferring a downhole force through said mandrel to said downhole slip assembly.

10. A packer for subterranean use against a borehole wall, comprising:

a mandrel supporting an outer assembly further comprising a sealing element flanked on opposing sides with an uphole and a downhole slip assembly;

said mandrel, after said sealing element and slip assemblies are engaged to the borehole wall, transmitting at least a portion of applied forces thereto in either an uphole or downhole direction, in an alternate path that avoids incremental loading of said sealing element;

said mandrel defines an uphole and a downhole space on opposed sides of said sealing element whose volume varies with relative movement between said mandrel and said outer assembly when said outer assembly engages the borehole wall;

said space on the uphole side of said sealing element defined by a cover sleeve;

said outer assembly further comprising an outer sleeve relatively movable with respect to said cover sleeve for extending said upper slip to the borehole wall.

11. The packer of claim 10, wherein:

said cover sleeve initially secured to said mandrel with a breakable member.

12. The packer of claim 11, wherein:

said outer sleeve and said cover sleeve further comprises a ratchet connection to allow said outer sleeve to move in an uphole direction relative to a stationary cover sleeve for extending said uphole slip to the borehole wall.

13. The packer of claim 12, wherein:

said cover sleeve movable uphole after said breakable member is broken only in tandem with said outer sleeve due to said ratchet connection.

14. The packer of claim 13, wherein:

said uphole space comprises a biasing member that is compressed as said breakable member is broken, whereupon said tandem movement transfers force to said uphole slip through said outer sleeve.

* * * * *